US009144712B2

(12) United States Patent
Gage

(10) Patent No.: US 9,144,712 B2
(45) Date of Patent: Sep. 29, 2015

(54) COMPOSITE DIVE FIN ASSEMBLY

(71) Applicant: FINQUEST, INC., Key West, FL (US)

(72) Inventor: Richard D. Gage, Key West, FL (US)

(73) Assignee: Finquest, Inc., Key West, FL (US)

( * ) Notice: Subject to any disclaimer, the term of this patent is extended or adjusted under 35 U.S.C. 154(b) by 57 days.

(21) Appl. No.: 13/789,029

(22) Filed: Mar. 7, 2013

(65) Prior Publication Data

US 2014/0256198 A1 Sep. 11, 2014

(51) Int. Cl.
*A63B 31/11* (2006.01)
*A63B 31/08* (2006.01)

(52) U.S. Cl.
CPC ..... *A63B 31/11* (2013.01); *A63B 31/08* (2013.01); *A63B 2031/115* (2013.01); *A63B 2209/02* (2013.01)

(58) Field of Classification Search
CPC ..... A63B 31/00; A63B 31/08; A63B 31/11
USPC ..... 441/61, 62, 63, 64
See application file for complete search history.

(56) References Cited

U.S. PATENT DOCUMENTS

| | | | | |
|---|---|---|---|---|
| 3,078,482 | A | 2/1963 | Crowder | |
| 3,109,186 | A | 11/1963 | Glenn | |
| 4,929,206 | A | 5/1990 | Evans | |
| 5,055,075 | A | 10/1991 | Waller, Jr. | |
| 5,906,525 | A | 5/1999 | Melius et al. | |
| 6,050,868 | A * | 4/2000 | McCarthy | 441/64 |
| D450,365 | S | 11/2001 | Evans | |
| D455,188 | S | 4/2002 | Evans | |
| 7,040,942 | B1 | 5/2006 | Houck | |
| 7,083,485 | B2 * | 8/2006 | Melius | 441/64 |
| 2001/0044246 | A1 | 11/2001 | McCarthy | |
| 2001/0051477 | A1 | 12/2001 | Evans | |
| 2008/0108259 | A1 | 5/2008 | Melius | |

OTHER PUBLICATIONS

Fish, "Freediving and Biomimetic Propulsion", DeeperBlue.com; https://www.deeperblue.com/freediving-biomimetic-propulsion/?utm_source=DeeperBlue.com+-+Main&utm_campaign=f8d7bda52a-RSS_EMAIL_CAMPAIGN&%E2%80%A6; Published Nov. 11, 2014; c. 1996; pp. 1-10.

* cited by examiner

*Primary Examiner* — Lars A Olson
(74) *Attorney, Agent, or Firm* — Morris & Kamlay LLP

(57) ABSTRACT

A composite dive fin assembly for a user swimming in a body of water having primary, secondary, and lateral portions which each define corresponding oppositely disposed propulsion surfaces. The primary, secondary, and lateral portions also each having a corresponding propulsion edge. The primary, secondary, and lateral propulsion surfaces cooperatively oriented to displace an amount of water over a corresponding one of the primary, secondary, and lateral propulsion edges when the composite dive fin assembly is moved in the body of water in which the user is swimming. The primary, secondary, and lateral propulsion surfaces are cooperatively configured to displace a greater amount of water over corresponding propulsion edges relative to previously known dive fins while reducing the resistive forces while displacing water, allowing a user to swim further and/or faster with the less effort.

18 Claims, 19 Drawing Sheets

COMPOSITE DIVE FIN ASSEMBLY

BACKGROUND OF THE INVENTION

1. Field of the Invention

The present invention is directed to a composite dive fin assembly comprising primary, secondary, and lateral propulsion surfaces cooperatively configured to displace an increased amount of water per kick or stroke over corresponding propulsion edges while reducing resistive forces to displacement of water, thereby allowing a user to swim further, faster, and with the less effort relative to heretofore previously known dive fins.

2. Description of the Related Art

The use of dive fins to help a swimmer move more efficiently through a body of water is well known. Numerous variations on dive fins have been used throughout the years having a generally flat elongated blade with raised edges along each side which serve to direct and displace water off the terminal or trailing end of the dive fin. The displacement of water off the trailing end of the dive fin provides the force or thrust which helps propel the swimmer through the body of water. Typically, the trailing or terminal end of a dive fin is about six to twelve inches from side to side.

The majority of known dive fins have this same general type of structure, the major differences being the shape or configuration of the terminal end such as concave, convex, scalloped, ribbed, thicker, thinner, etc., however, they are still structured to direct water to the trailing end of the dive fin. As such, they all operate in essentially the same manner, that is to say, the surface of the fin combined with the raised edges form a scoop like configuration which the user forces through the water as he or she kicks, i.e., a stroke, which displaces water from a proximal end towards a distal end and over the trailing end of the dive fin. Of course, similar to moving a spoon or ladle through a liquid, this scoop configuration provides considerable resistance, and thus requires a considerable amount of effort and energy on the part of the swimmer in order to displace water and propel themselves.

As the overwhelming majority of known dive fins comprise this type of configuration, the majority of known dive fins suffer from the same inherent flaws, i.e., significant energy is required of the user to displace limited amounts of water for thrust. Of course, there have been attempts to improve upon the hydrodynamic characteristics of this conventional dive fin configuration, however, the known alternatives still fall short of effectively increasing the amount of water displaced while reducing the amount of energy required when a dive fin is moved through the water as a swimmer kicks.

As one example, a multiple serial hydrofoil swim fin design includes air foil like fins attached to a planar blade member. In at least one embodiment, the air foil like side fins and tail member are cooperatively structured to direct water flow alternately over and/or under the surfaces of each in attempts to aid propelling a swimmer through the water. Once again, however, and similar to the aforementioned conventional dive fin configurations, thrust is still provided via water displaced over the trailing end of single tail fin at the distal end of the hydrofoil swim fin.

Another variation includes a conventional dive fin attached along the sides of the user's legs. This dive fin, however, once again comprises a generally flat surface having raised edges defining a scoop like configuration, thus still requiring significant effort by the swimmer in order to displace water in order to propel himself or herself. In addition, given the reduced overall size of this particular dive fin variation it is believed that the amount of water displaced per stroke will also be less than that displaced by a conventional known dive fin as described above.

Other variations include forming the trailing end of a dive fin in the shape of various fish tails, however, each of these supposed improvements suffer from the same defect noted above, i.e., water is only displaced off of the trailing end of the dive fin itself, thereby inherently limiting the amount of water displaced per kick or stroke by a swimmer in a body of water.

Thus, it would be beneficial to provide an improved dive fin assembly specifically structured to displace a greater amount of water per kick or stroke than is currently possible while swimming with the aforementioned and previously known dive fins. This, in and of itself, would allow swimmers to propel themselves farther and/or faster. It would be further beneficial to provide an improved dive fin assembly which reduces resistance to displacing water across its propulsion surface or surfaces, once again, such that swimmers can propel themselves farther and/or faster. A further advantage may be realized from such an improved dive fin assembly by incorporating one or more flexible portions along its length disposed to increase action of one or more portions thereof so as to generate secondary propulsion forces.

SUMMARY OF THE INVENTION

The present invention is a composite dive fin assembly which allows a person swimming in a body of water to move faster and/or farther with less energy than required by known dive fins. The composite dive fin assembly includes a foot hold for removably positioning a composite fin on each of the swimmer's feet. The composite fin has a proximal end and a distal end, and in at least one embodiment, the foot hold is mounted adjacent the proximal end of the composite fin.

The composite fin, in at least one embodiment, includes a flex line proximate the foot hold, wherein the proximal end and the distal end form a flex angle along the flex line. In at least one embodiment, the flex angle is in a range of about twenty degrees to thirty degrees.

The composite fin in one embodiment includes a primary portion having a primary leading edge and a primary propulsion edge defining oppositely disposed primary propulsion surfaces therebetween. In one further embodiment, a composite fin has a secondary portion having a secondary leading edge and a secondary propulsion edge defining oppositely disposed secondary propulsion surfaces therebetween. In yet one further embodiment, a composite fin comprises a lateral portion disposed between the primary portion and the secondary portion, wherein the lateral portion has a lateral propulsion edge at least partially defining oppositely disposed lateral propulsion surfaces therebetween.

In at least one embodiment, the corresponding primary propulsion surface, secondary propulsion surface, and lateral propulsion surface on each side of the composite fin are cooperatively oriented to displace an amount of water over a corresponding primary propulsion edge, secondary propulsion edge, and lateral propulsion edge when the composite dive fin assembly is moved in the body of water transverse to a direction in which the user is swimming, thereby providing the thrust required to propel the swimmer though the body of water. In at least one further embodiment, correspondingly disposed primary propulsion surfaces, secondary propulsion surfaces, and lateral propulsion surfaces are cooperatively configured to reduce resistive forces while displacing an amount of water over a corresponding primary propulsion edge, secondary propulsion edge, and lateral propulsion edge.

A break point is disposed between the lateral portion and the secondary portion, in at least one embodiment, wherein the secondary portion is movable relative to the lateral portion at the break point. More in particular, the secondary portion is structured to flex or snap relative to the lateral portion about the break point, resulting in a sudden additional displacement of water, thereby providing the swimmer with an added boost to propel themselves through the water.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
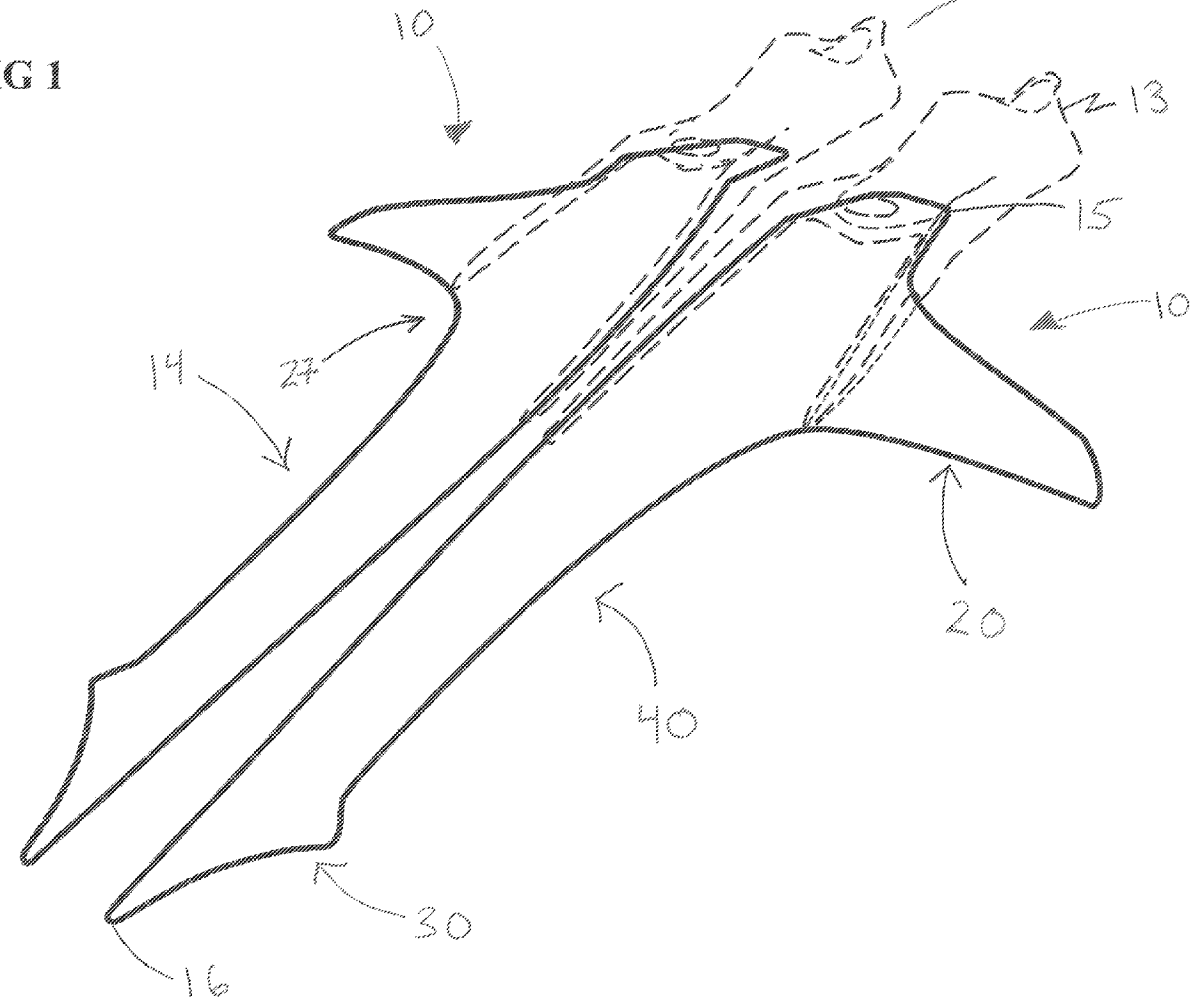
FIG. 1 is a perspective view of one illustrative embodiment of a pair of composite dive fin assemblies in accordance with the present invention.

As stated above, the present invention is directed to a composite dive fin assembly generally as shown at 10 throughout the figures which facilitate propelling a user through a body of water, such as while swimming or diving below the surface of a body of water. As shown throughout the Figures, the composite dive fin assembly 10 of the present invention is amenable to a number of embodiments. As may also be seen from the Figures, several embodiments of the composite dive fin assembly 10 in accordance with the present invention are specifically configured to resemble the tails of various types of sharks, as sharks have evolved over millions of years to optimize thrust while moving through a body of water with minimal effort.

More in particular, FIGS. 1 through 6 are illustrative of an embodiment of a pair of composite dive fin assemblies 10 each configured to generally resemble the tail fin of a hammerhead shark; FIGS. 7 through 12 are illustrative of a pair of composite dive fin assemblies 10 each configured to generally resemble the tail fin of an ocean white tip shark; FIGS. 13 through 18 are illustrative of an embodiment of a pair of composite dive fin assemblies 10 each configured to generally resemble a generic shark tail fin; FIGS. 19 through 24 are illustrative of an embodiment of a pair of composite dive fin assemblies 10 each configured to generally resemble the tail fin of a thresher shark; and, FIGS. 25 through 30 are illustrative of an embodiment of a pair of composite dive fin assemblies 10 each configured to generally resemble the tail fin of a tiger shark. In addition, FIGS. 31 through 36 are illustrative of a unitary composite dive fin assembly 10 in accordance with the present invention having a configuration generally resembling hammerhead shark tail fins adjoined together.

While the following disclosure is focused primarily on the embodiment of a composite dive fin assembly 10 as presented in the illustrative embodiment of FIGS. 1 through 6, once again, generally resembling the tail fin of a hammerhead shark, the structure of a composite dive fin assembly 10 in accordance with the present invention is similar throughout the various embodiments. Thus, the discussion of the structure of the illustrative embodiment of FIGS. 1 through 6 is applicable to other embodiments of a composite dive fin assembly 10 in accordance with the present invention, such as are illustrated in FIGS. 7 through 36, unless specifically indicated otherwise hereinafter.

FIG. 1 is illustrative of a pair of composite dive fin assemblies 10 in accordance with one embodiment of the present invention. As may be seen from FIG. 1, as well as in FIGS. 2 through 6, the pair of composite dive fin assemblies 10 are mirror images of one another, one being intended for the right foot of a user and the other intended for the left foot of the user. As further shown in FIG. 1, each composite dive fin assembly 10 comprises a foot hold 12 which allows a user to removably position the composite dive fin assembly 10 onto his or her foot, once again, either right foot or left foot. In at least one embodiment, the foot hold 12 is fixedly attached to a composite fin 14 such as is shown, by way of example, in FIGS. 1 through 6, by mechanical fasteners, sewing, adhesives, etc. Of course, in at least one further embodiment, the foot hold 12 is removably mounted to a composite dive fin assembly 10 in accordance with the present invention such as by snaps, clips, pins, etc. This configuration permits a user to interchange composite fins 14 as dictated by different diving conditions. Further, this would allow a user to have a custom fit foot hold 12 to maximize comfort and support while utilizing a composite dive fin assembly 10 of the present invention, versus the one size fits all approach typically provided on most known dive fins. For example, as shown throughout the figures, the foot hold 12 comprises a closed boot 13 in which a user can place his or her foot in order to removably position the composite dive fin assembly 10 thereto.

As an alternative to the closed boot 13 as shown throughout the figures, a foot hold 12 may comprise one or more straps in order to removably position a composite dive fin assembly 10 to a user's foot. Other embodiments of a foot hold 12 in accordance with the present invention include, but are not limited to, an open back boot, a boot and strap combination, or a dive shoe or sock, just to name a few, in order to removably position the composite fin 14 in an operable orientation on a user's foot. In one further embodiment, the foot hold 12 is integrally molded into or onto the composite fin 14 itself.

The foot hold 12 may be constructed from any of a number of materials which exhibit sufficient flexibility and water resistant properties. As one example, the foot hold may be constructed from natural rubber, synthetic rubber, thermoplastics, etc. Alternatively, the foot hold 12 may be constructed of neoprene, nylon, or other natural or synthetic fibers. In yet one further embodiment, one portion of the foot hold 12, for example, the base portion, is constructed from natural rubber, synthetic rubber, thermoplastics, etc., while another portion, for example, the upper portion, is constructed of neoprene, nylon, or other natural or synthetic fibers.

As stated above, the composite dive fin assembly 10 in accordance with the present invention includes a composite fin 14 such as illustrated in FIG. 1. The composite fin 14 has a proximal end 15 and a distal end 16 and, in at least one embodiment, the composite fin 14 comprises an elongated configuration extending between said proximal end 15 and said distal end 16. The foot hold 12 is mounted to the composite fin 14, whether fixedly or removably, at the proximate end 15 thereof, once again, as illustrated throughout the figures.

A composite fin 14 in accordance with the present invention may be constructed from any of a variety of suitable materials including, but in no manner limited to, carbon fiber, carbon/KEVLAR®, carbon/KEVLAR® hybrid, carbon fiber/fiberglass, KEVLAR®, fiberglass, carbon/ZYLON® hybrid, Hexcel TEXALIUM®, high impact plastic, rubber, etc. It is also within the scope and intent of the present invention for a composite fin 14 to be construed from more than one material. By way of example only, one material may be used to form the overall shape or configuration of the composite fin 14, and an additional material or materials may be utilized as overlays to thicken and/or strengthen specific portions of the composite fin 14.

Looking further to FIG. 1, the composite fin 14 comprises a plurality of interconnected portions. More in particular, composite fin 14 in accordance with the present invention comprises a primary portion 20 which is disposed adjacent the proximal end 15 of the composite fin 14. In addition, a composite fin 14, in at least one embodiment, comprises a secondary portion 30 disposed proximate the distal end 16 of the composite fin 14. In addition, composite fin 14 comprises a lateral portion 40 disposed between primary portion 20 and secondary portion 30 such as, for example, as is shown in the illustrative embodiment of FIG. 1.

Figure 2:
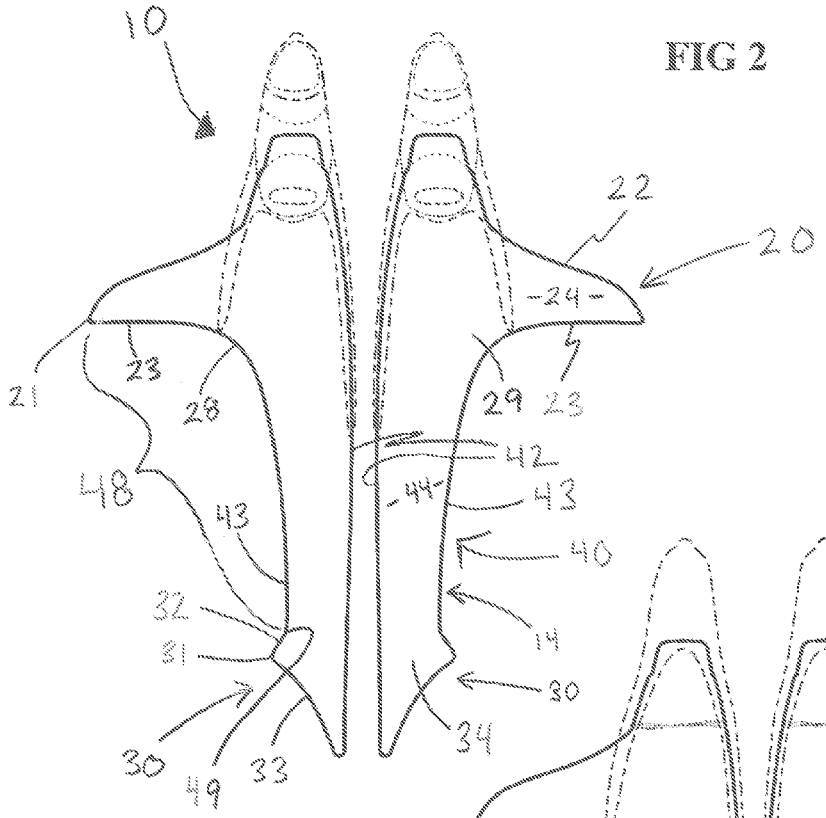
FIG. 2 is a top plan view of the pair of composite dive fin assemblies of the illustrative embodiment of FIG. 1.
Figure 3:
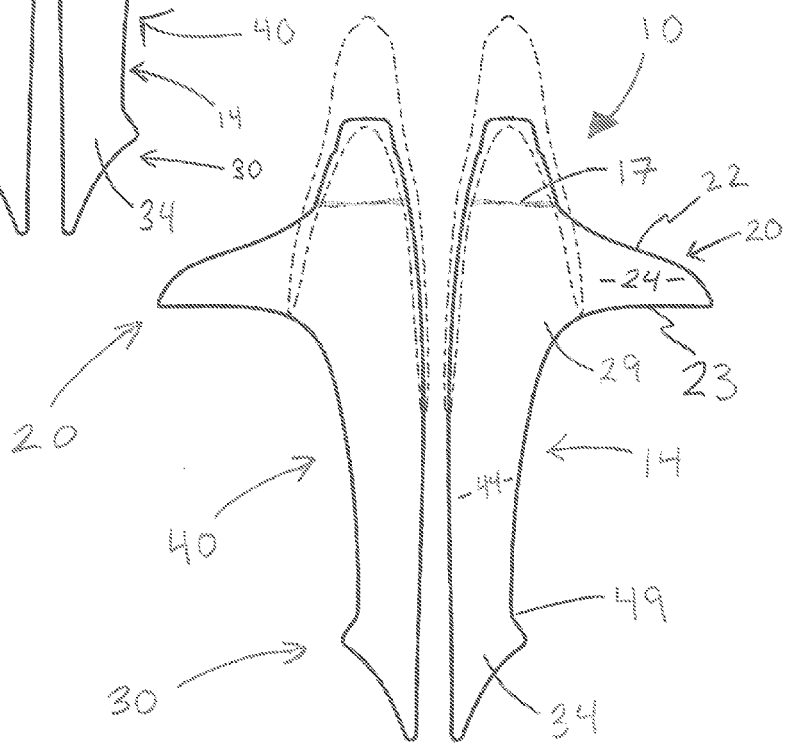
FIG. 3 is a bottom plan view of the pair of composite dive fin assemblies of the illustrative embodiment of FIG. 1.

Turning next to FIG. 2, the primary portion 20 includes a primary leading edge 22 and a primary propulsion edge 23 which extend outwardly from composite fin 14 and converging at a primary portion tip 21, thereby forming a generally fin shaped configuration. More in particular, primary leading edge 22 and propulsion edge 23 collectively define primary propulsion surfaces 24 therebetween. FIG. 2 is a top plan view of a pair of composite fin assemblies 10 while FIG. 3 is a bottom plan view of the same pair of composite fin assemblies 10. As may be seen from FIGS. 2 and 3, the primary leading edge 22 and primary propulsion edge 23 of primary portion 20 define oppositely disposed primary propulsion surfaces 24 on each of the top and bottom surfaces of the composite fin 14.

Similarly, the secondary portion 30 includes a secondary leading edge 32 and a secondary propulsion edge 33 which, in the illustrative embodiment of FIGS. 1 through 6, also extend outwardly from composite fin 14 and converge at a secondary portion tip 31, once again, in a generally fin shaped configuration. Secondary leading edge 32 and secondary propulsion edge 33 collectively define secondary propulsion surfaces 34 therebetween. Once again, FIG. 2 is a top plan view of a pair of composite fin assemblies 10 while FIG. 3 is a bottom plan view of the same pair of composite fin assemblies 10 and together they are illustrative of secondary leading edge 32 and secondary propulsion edge 33 of secondary portion 30 defining oppositely disposed secondary propulsion surfaces 34 on each of the top and bottom surfaces of the composite fin 14.

With reference to the illustrative embodiment of the composite dive fin assemblies 10 of FIG. 2, elongated lateral portion 40 is shown and, as noted above, is disposed between primary portion 20 at the proximal end 15 of the composite fin 14 and secondary portion 30 at the distal end 16 of the composite fin 14. As shown in FIG. 2, lateral portion 40 includes an inner edge 42 and a lateral propulsion edge 43. Similar to primary portion 20 and secondary portion 30, corresponding ones of inner edge 42 and lateral propulsion edge 43 of the lateral portion 40 define lateral propulsion surfaces 44 therebetween on oppositely disposed sides of the composite fin 14, as shown best, once again in FIGS. 2 and 3.

Also shown in FIG. 2 is that inner edge 42 of the lateral portion 40 comprises a generally linear configuration on each mirror image composite dive fin assembly 10. Thus, a user donning a pair of composite dive fin assemblies 10 in accordance with the present invention would position each first portion 20 extending outwardly from his or her body, with inner edges 42 facing inwardly toward one another and the primary portion 20 of each composite dive fin assembly 10 extending outwardly from the swimmer's body on each of the swimmer's right or left sides.

FIG. 1 illustrates a transition zone 27 disposed between the primary portion 20 and the lateral portion 40. The transition zone 27 is at least partially defined by transition edge 28 which, in at least the illustrative embodiment of FIG. 2, comprises a generally arcuate configuration. The transition zone 27 interconnects the outwardly extending primary portion 20 with the lateral portion 40 disposed in a transverse, generally perpendicular orientation relative to the primary portion 20. As shown in FIGS. 2 and 3, the transition zone edge 28 comprises oppositely disposed transition propulsion surfaces 29, once again, on each of the top and bottom surfaces of the composite fin 14. Further, and as illustrated best in FIG. 2, primary propulsion 23 edge, transition zone edge 28, and lateral propulsion edge 43 are cooperatively structured to form a continuous propulsion edge 48 extending from the primary portion tip 21 to the break point 49 between lateral portion 40 and the secondary portion 30.

Figure 37:
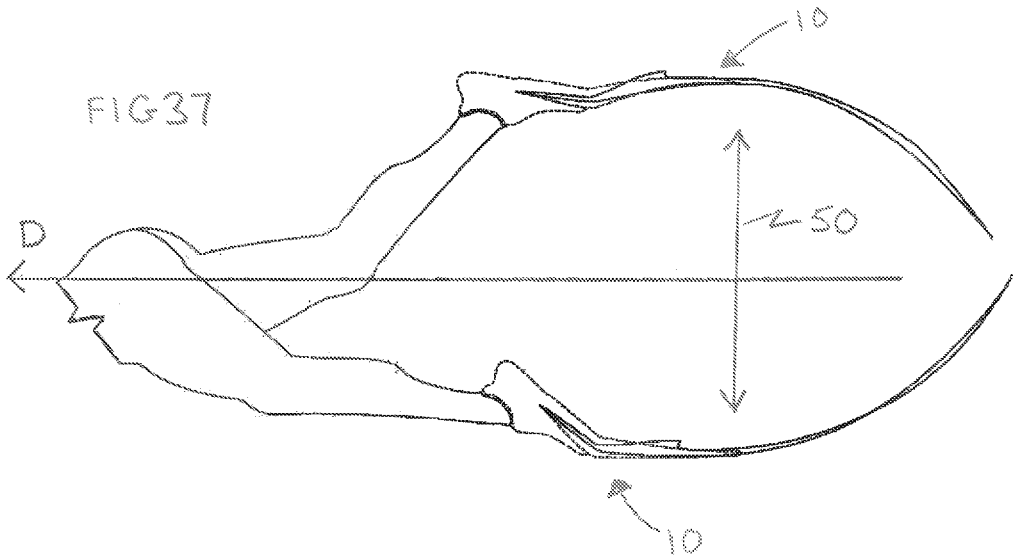
FIG. 37 is a side elevation illustrative of a pair of composite dive fin assemblies in accordance with at least one embodiment of the present invention in use.

Having discussed each of the primary portion 20, secondary portion 30, and lateral portion 40 of the present composite dive fin assembly 10 individually, the following describes the interaction of the various portions 20, 30, 40 to effect a greater displacement of water when a composite dive fin assembly 10 of the present invention moves though water. Looking once again to FIGS. 2 and 3, a composite fin 14 includes a primary propulsion surface 24 and a secondary propulsion surface 34 interconnected by an elongated lateral propulsion surface 44 oppositely disposed on both the top and bottom of the composite fin 14. Upon movement of composite dive fin assemblies 10 in a direction transverse and generally perpendicular to a direction which a user is swimming, such as is illustrated by directional arrows 50 and "D" in FIG. 37, respectively, an amount of water is almost immediately displaced by primary propulsion surfaces 24 over primary propulsion edges 23, thereby resulting in almost instantaneous movement of a user as they begin to kick and move the composite dive fin assemblies 10 in a body of water.

Further, water is displaced over transition propulsion surfaces 29 and down along lateral propulsion surfaces 44, and over the transition zone edge 28 and the lateral propulsion edge 43, respectively. The foregoing combined actions result in greater amounts of water being displaced over the entirety of the continuous propulsion edge 48 than is possible utilizing presently known dive fins. In at least one embodiment, the continuous composite propulsion edge 48 is between thirty and forty inches in overall length, which is about two and one-half to five times the length of the trailing end of known dive fins. In addition, and as illustrated throughout the figures, none of propulsion edges 23, 33, 43, or 48 include raised edges or any other structure to restrict a flow of displaced water thereover. As such, the resistive forces to the displacement of water over propulsion edges 23, 33, 43, or 48 is necessarily less than that of known dive fins. More in particular, the configuration of continuous propulsion edge 48, specifically, the generally smooth and continuous transition from primary propulsion edge 23 around arcuate transition zone edge 28 and down elongated lateral propulsion edge 43 allows water to be displaced along the entirety of the continuous propulsion edge 48, necessarily reducing the resistive forces to displacement of a corresponding amount of water individually over corresponding ones of the primary propulsion edge 23, transition zone edge 28, and/or lateral propulsion edge 43, as a result of frictional end losses.

Additionally, the composite dive fin assembly 10 of the present invention includes secondary propulsion surfaces 34 along which an additional amount of water is displaced, in this case, over secondary propulsion edge 33, further increasing the amount of water displaced per stroke through a body of water than can be achieved using a known dive fin.

Figure 4:
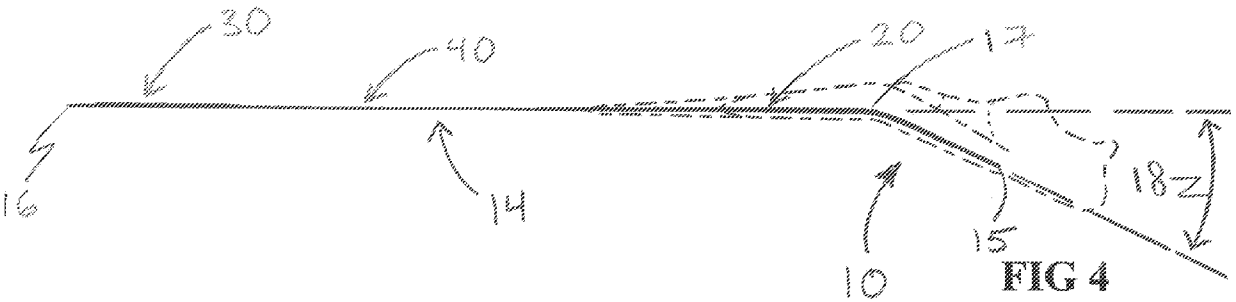
FIG. 4 is a side elevation of one of the composite dive fin assemblies of the illustrative embodiment of FIG. 1.
Figure 5:
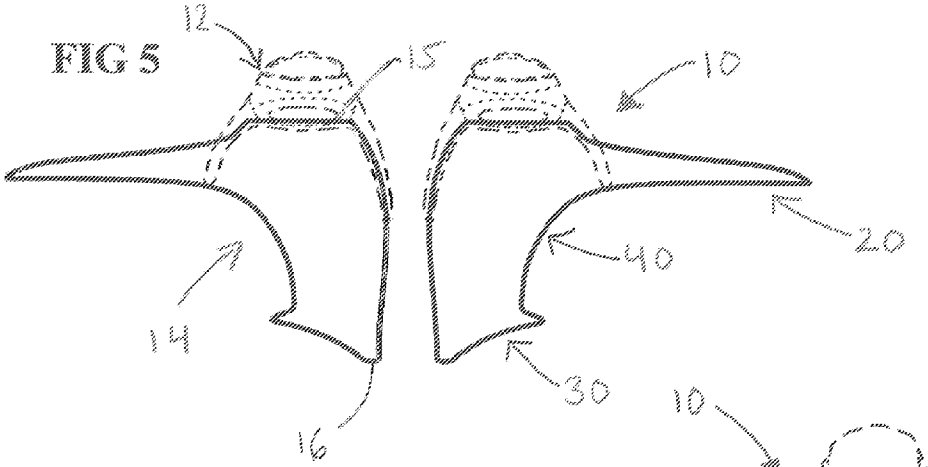
FIG. 5 is a front elevation of the pair of composite dive fin assemblies of the illustrative embodiment of FIG. 1.
Figure 6:
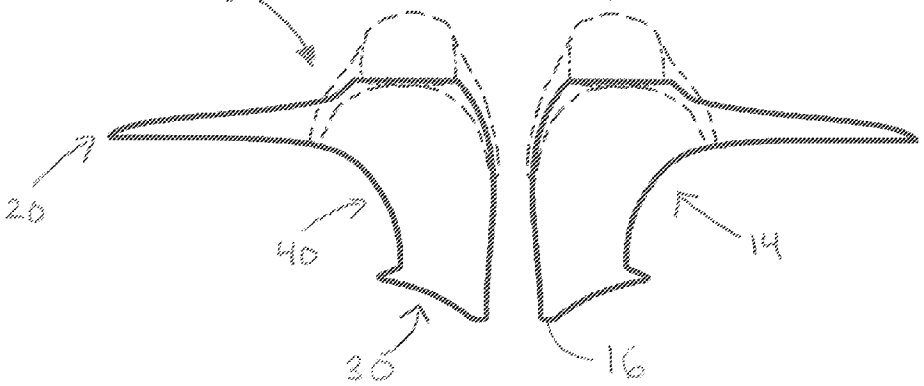
FIG. 6 is a rear elevation of the pair of composite dive fin assemblies of the illustrative embodiment of FIG. 1.
Figure 7:
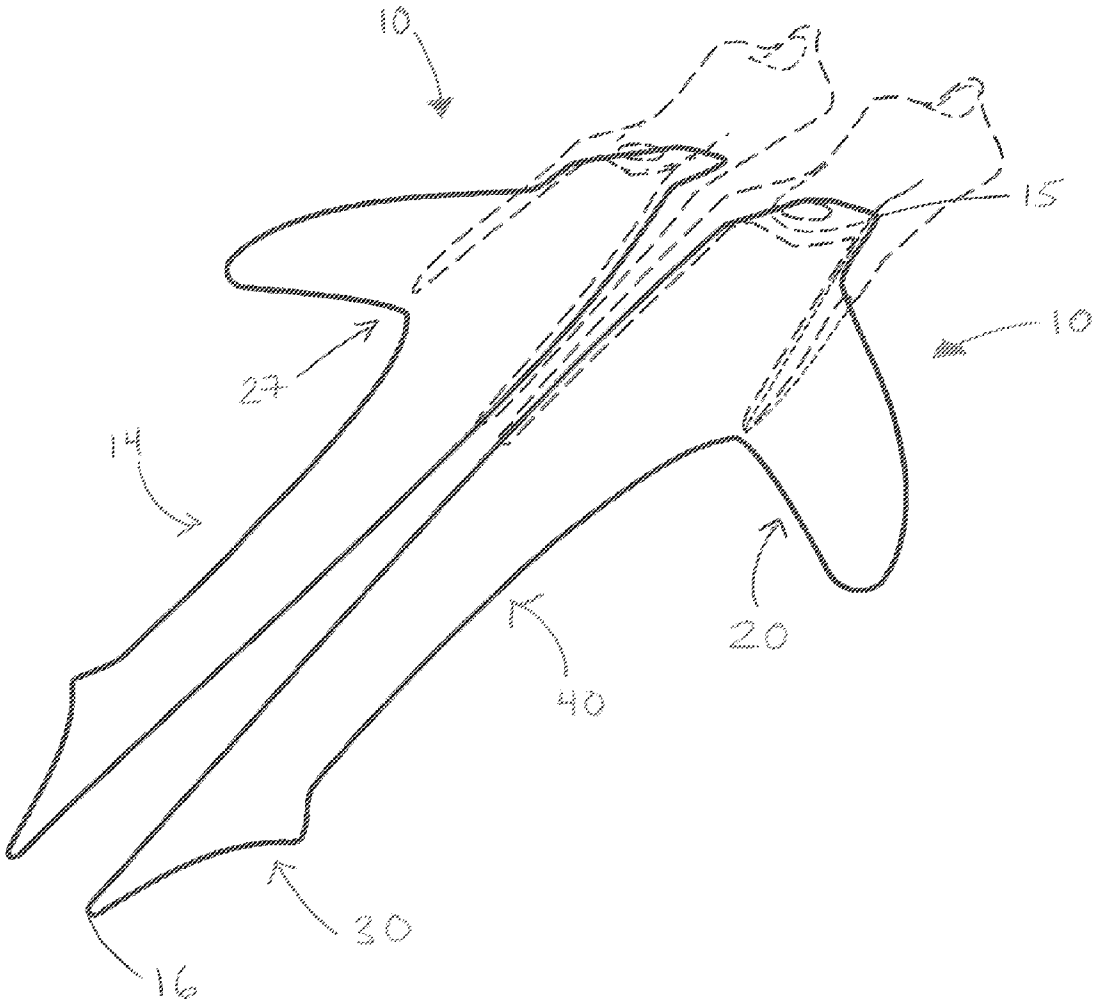
FIG. 7 is a perspective view illustrative of another embodiment of a pair of composite dive fin assemblies in accordance with the present invention.

Turning next to FIG. 4, a side elevation of a composite dive fin assembly 10 in accordance with the present invention is illustrated. In particular, FIG. 4 illustrates a flex line 17, also shown in FIG. 3, along which the proximal end 14 and distal end 16 of composite fin 14 form a flex angle 18. In at least one embodiment, the flex angle 18 is in a range of about twenty to thirty degrees. In at least one further embodiment of the composite dive fin assembly 10 in accordance with the present invention, a flex angle 18 is about twenty-five degrees. As such, and as shown best in FIGS. 5 and 6, when the composite dive fin assemblies 10 in accordance with the present invention are placed on a user's feet, the distal end 16 of the composite fin 14 will tend to bend downwardly at an angle generally in the range of flex angle 18. More importantly, the flex angle 18 between the proximal end 15 and distal end 16 of the composite fin 14 serve to further reduce the resistive forces during displacement of an amount of water over the primary propulsion edge 23, secondary propulsion edge 33, and lateral propulsion edge 43. Once again, the configuration of the composite dive fin assembly 10 in accordance with the present invention permits a user to displace a greater amount of water per stroke while requiring less force or energy by the user to do so compared to known dive fins.

Figure 38:
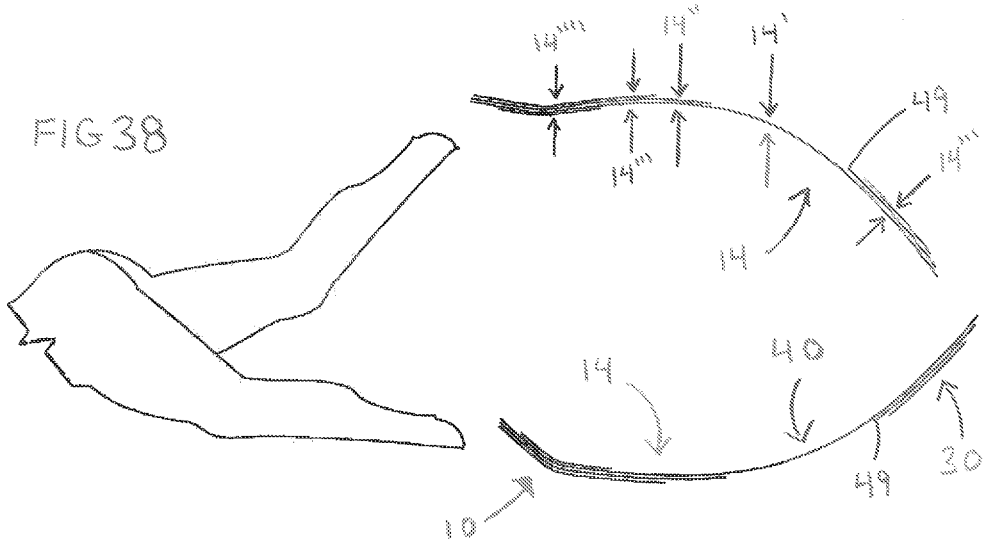
FIG. 38 is diagrammatic representation of the pair of composite dive fin assemblies of FIG. 37 illustrative of variable thickness of the composite fins at various points along their respective lengths.

Another feature of at least one embodiment of a composite dive fin assembly 10 of the present invention is a break point 49 disposed at an interface between lateral portion 40 and secondary portion 30. More in particular, the break point 49 is a transition between thinner and thicker portions of the composite fin 14. As illustrated diagrammatically in FIG. 38, the thickness of a composite fin 14 may vary along its length from the thinnest portion 14' to the thickest portion 14''''. In at least one embodiment, the thinnest portion 14' of composite fin 14 is about one-eighth of an inch. Looking once again to the diagrammatic representation of FIG. 38, the break point 49 is disposed at a transition between the thinnest portion 14' of composite fin 14, which in this example is in the lateral portion 40, and a thicker portion 14''', such as in secondary portion 30, as shown. Thus, the thicker secondary portion 30 will tend to flex or snap relative to the thinner lateral portion 40 during a change in direction of a stroke. The flex or snap of the secondary portion 30 will rapidly displace an additional amount of water over secondary propulsion edge 33, resulting in an added boost or thrust to the swimmer as he or she moves through the water.

Thus, a composite dive fin assembly 10 in accordance with the present invention will displace a greater amount of water, as one example, between about two and half to five times the amount of water per stroke than previously possible utilizing known dive fins. In addition, the user will experience less resistive forces while displacing water with the present composite dive fin assemblies 10 than with known dive fins. The net result of the foregoing is that a swimmer wearing composite dive fin assemblies 10 in accordance with the present invention will be able to swim faster and/or further with less effort than he or she would be able to accomplish with known dive fins.

Figure 8:
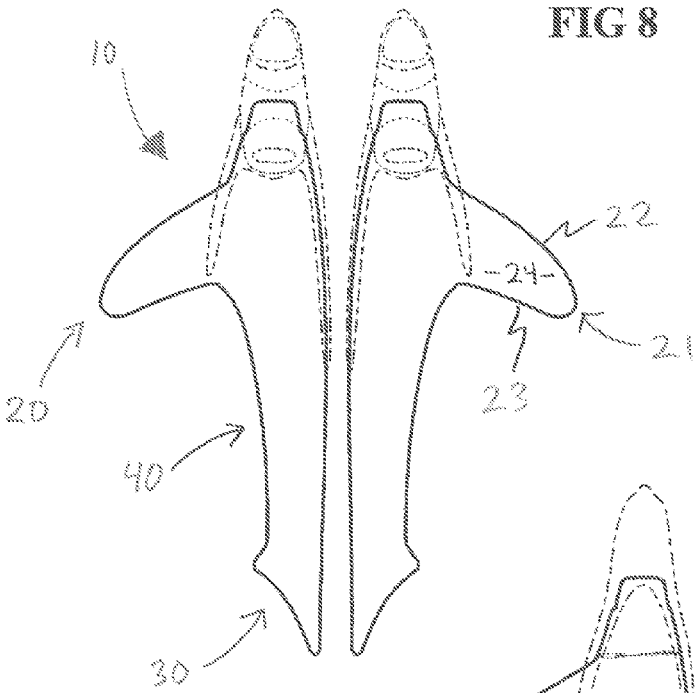
FIG. 8 is a top plan view of the pair of composite dive fin assemblies of the illustrative embodiment of FIG. 7.
Figure 9:
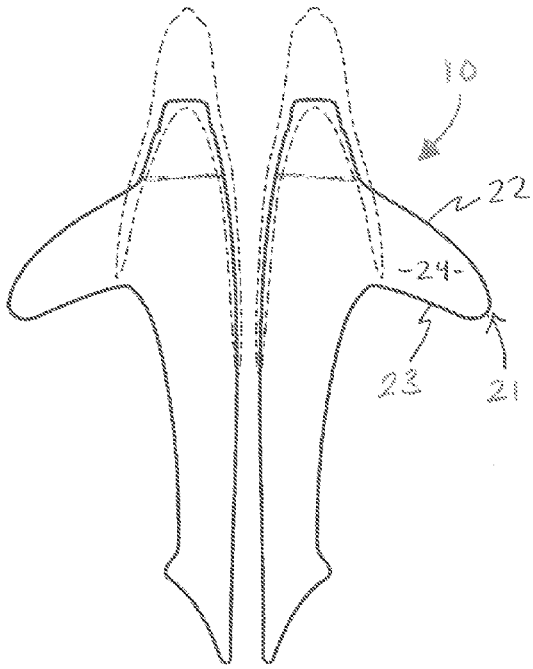
FIG. 9 is a bottom plan view of the pair of composite dive fin assemblies of the illustrative embodiment of FIG. 7.
Figure 10:
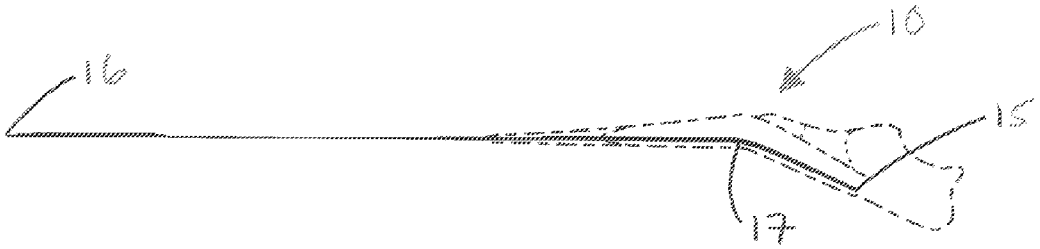
FIG. 10 is a side elevation of one of the composite dive fin assemblies of the illustrative embodiment of FIG. 7.
Figure 11:
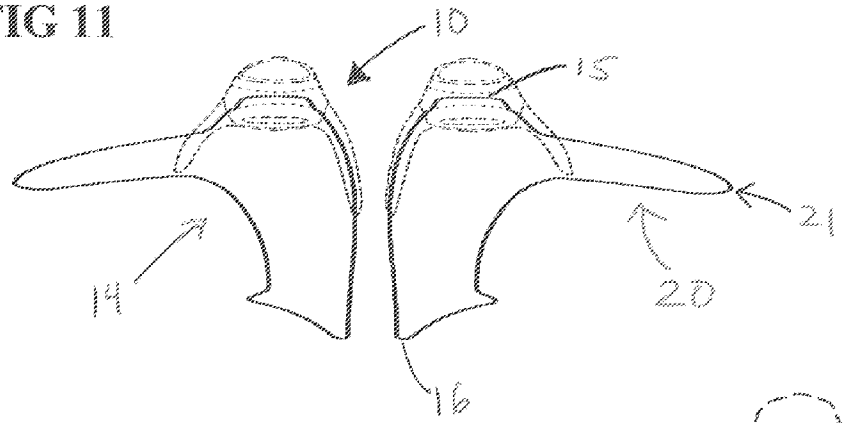
FIG. 11 is a front elevation of the pair of composite dive fin assemblies of the illustrative embodiment of FIG. 7.
Figure 12:
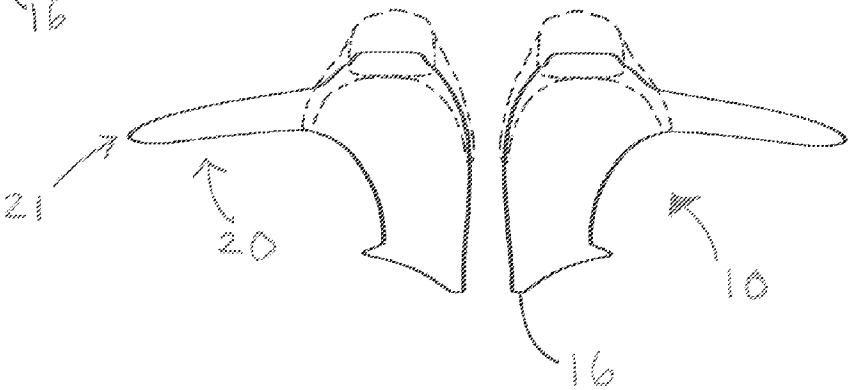
FIG. 12 is a rear elevation of the pair of composite dive fin assemblies of the illustrative embodiment of FIG. 7.
Figure 13:
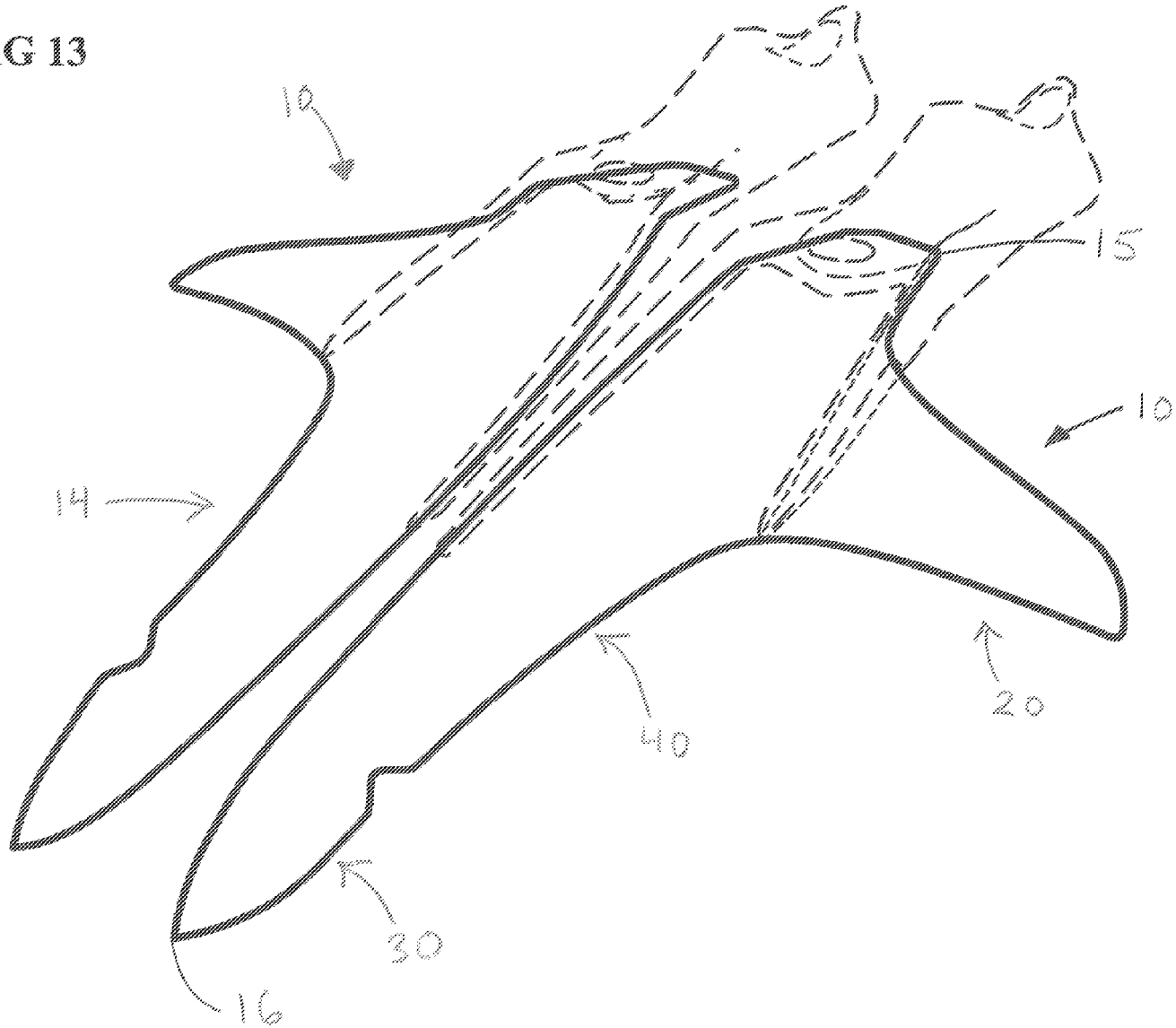
FIG. 13 is a perspective view illustrative of yet another embodiment of a pair of composite dive fin assemblies in accordance with the present invention.
Figure 14:
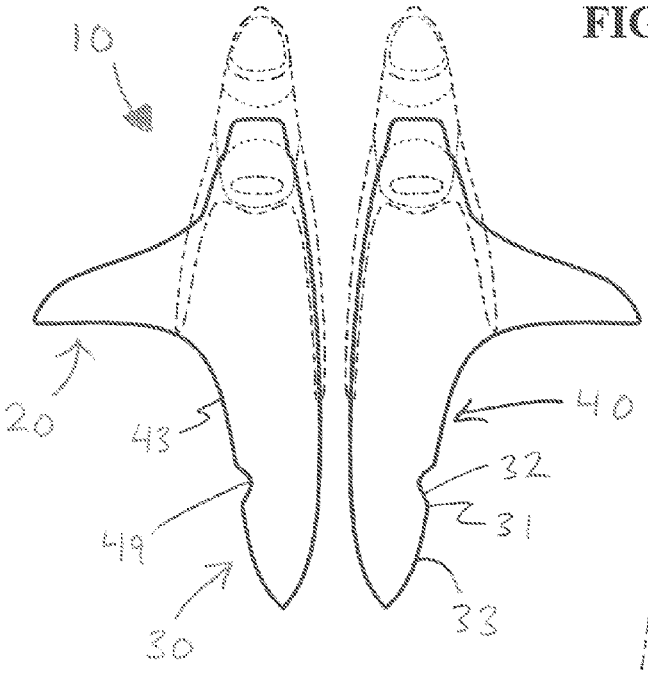
FIG. 14 is a top plan view of the pair of composite dive fin assemblies of the illustrative embodiment of FIG. 13.
Figure 15:
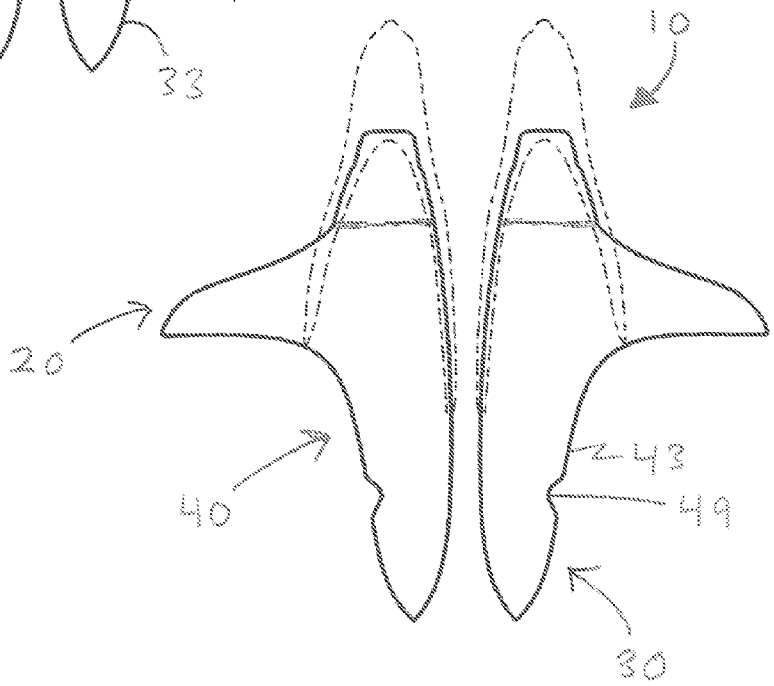
FIG. 15 is a bottom plan view of the pair of composite dive fin assemblies of the illustrative embodiment of FIG. 13.
Figure 16:
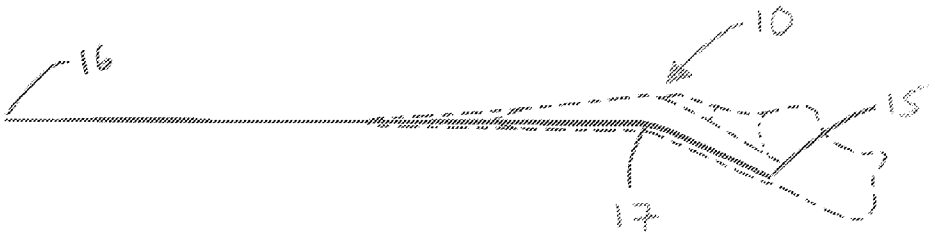
FIG. 16 is a side elevation of one of the composite dive fin assemblies of the illustrative embodiment of FIG. 13.
Figure 17:
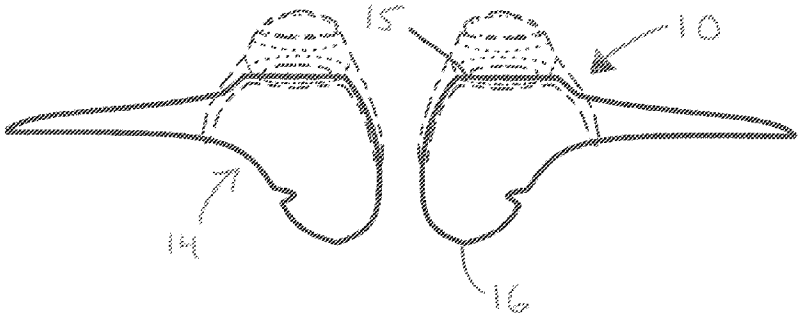
FIG. 17 is a front elevation of the pair of composite dive fin assemblies of the illustrative embodiment of FIG. 13.
Figure 18:
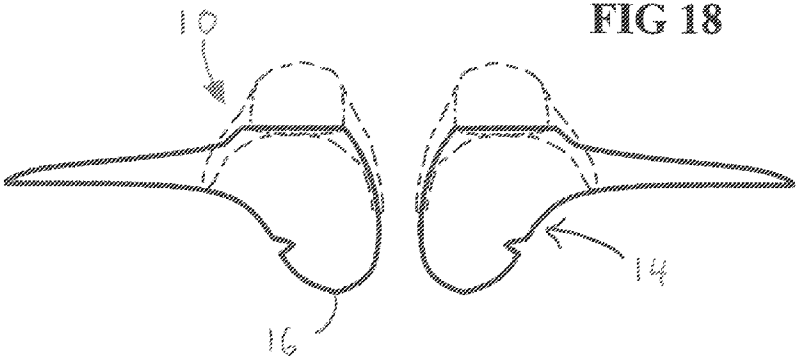
FIG. 18 is a rear elevation of the pair of composite dive fin assemblies of the illustrative embodiment of FIG. 13.
Figure 19:
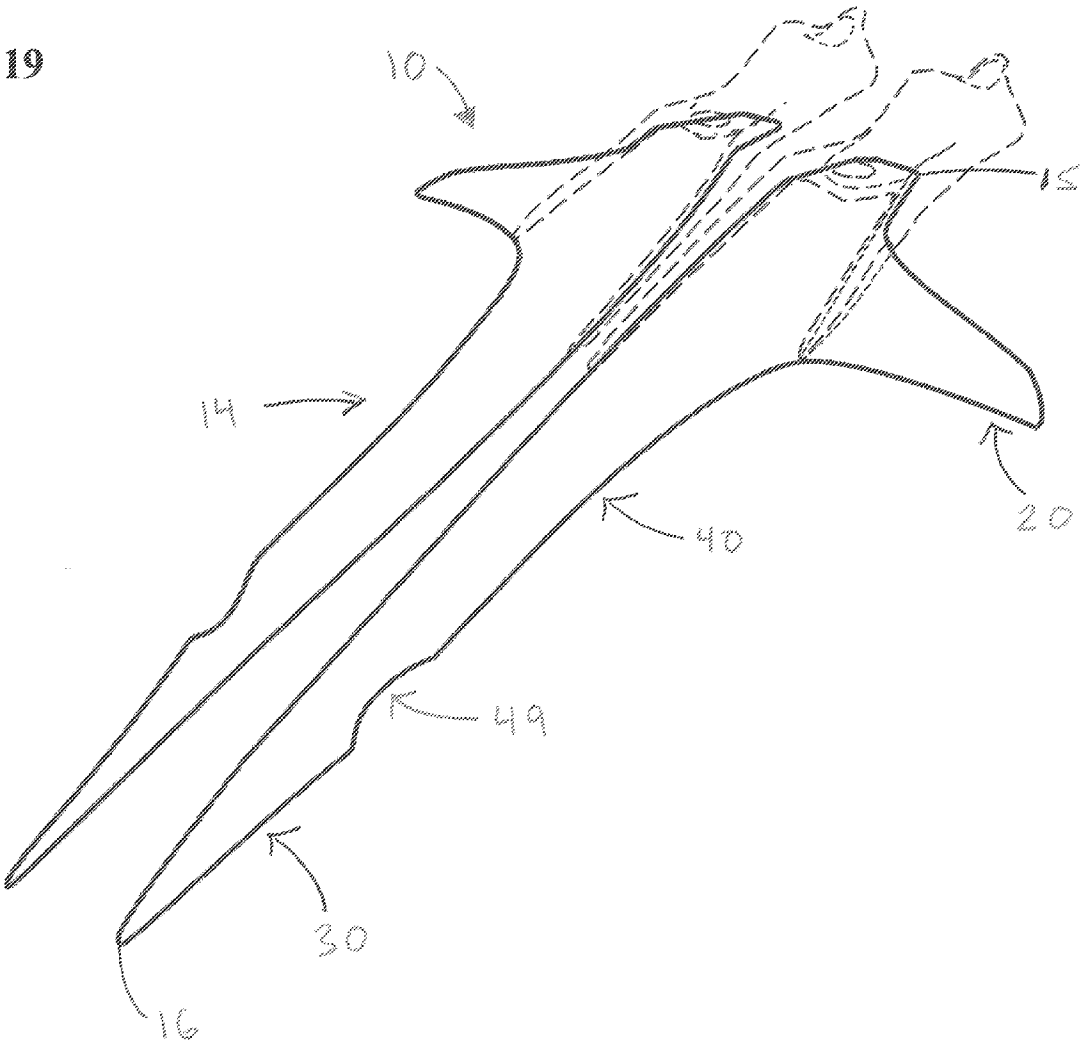
FIG. 19 is a perspective view illustrative of one further embodiment of a pair of composite dive fin assemblies in accordance with the present invention.
Figure 20:
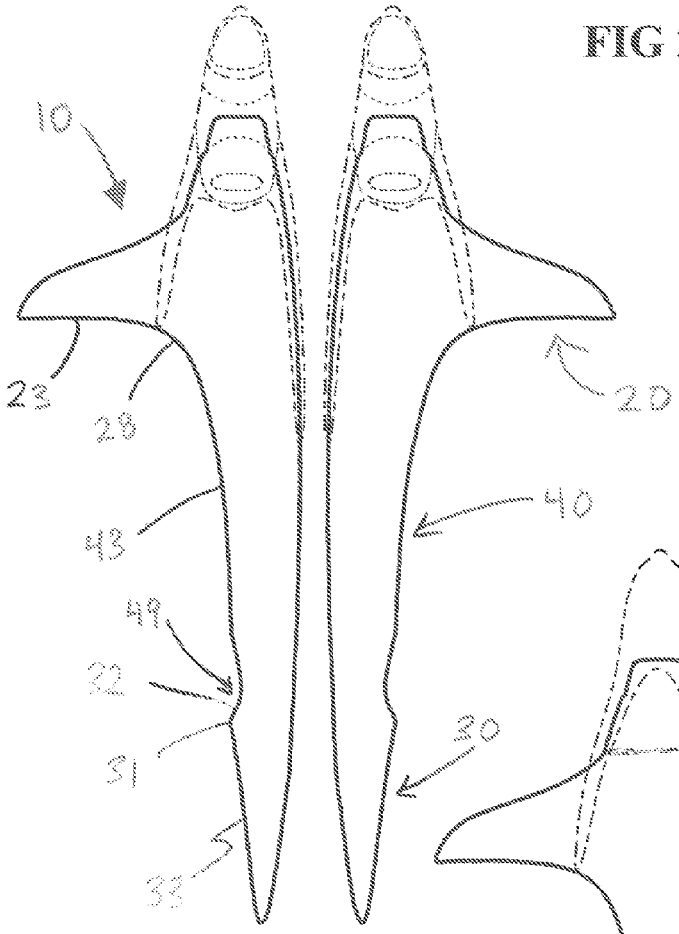
FIG. 20 is a top plan view of the pair of composite dive fin assemblies of the illustrative embodiment of FIG. 19.
Figure 21:
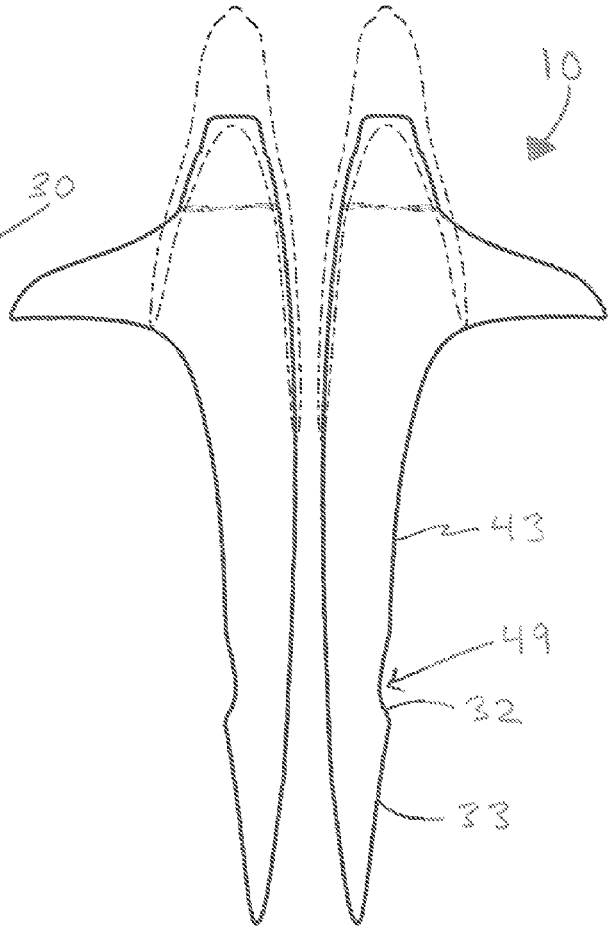
FIG. 21 is a bottom plan view of the pair of composite dive fin assemblies of the illustrative embodiment of FIG. 19.
Figure 22:
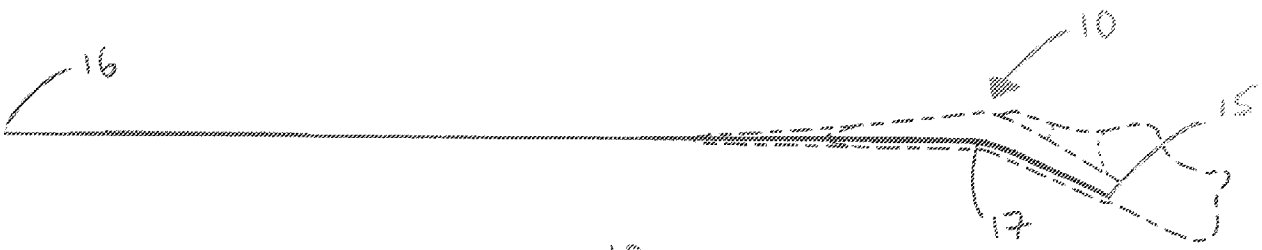
FIG. 22 is a side elevation of one of the composite dive fin assemblies of the illustrative embodiment of FIG. 19.
Figure 23:
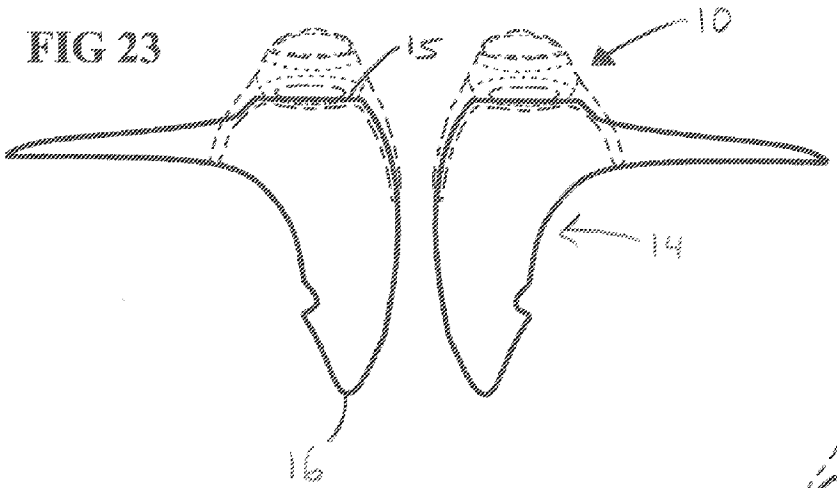
FIG. 23 is a front elevation of the pair of composite dive fin assemblies of the illustrative embodiment of FIG. 19.
Figure 24:
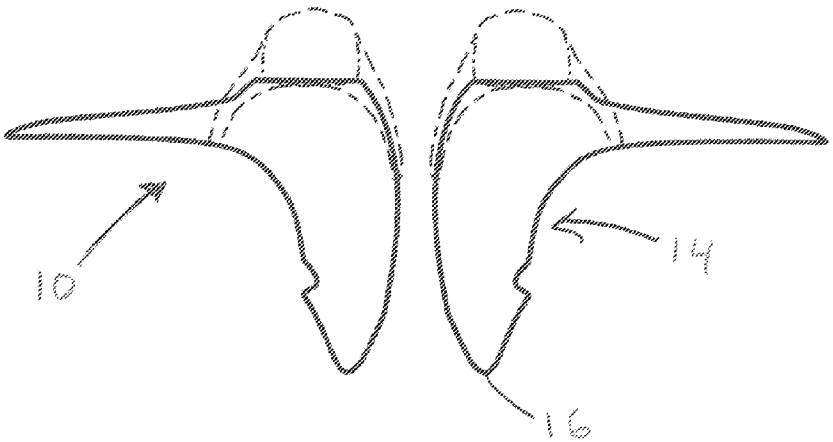
FIG. 24 is a rear elevation of the pair of composite dive fin assemblies of the illustrative embodiment of FIG. 19.
Figure 25:
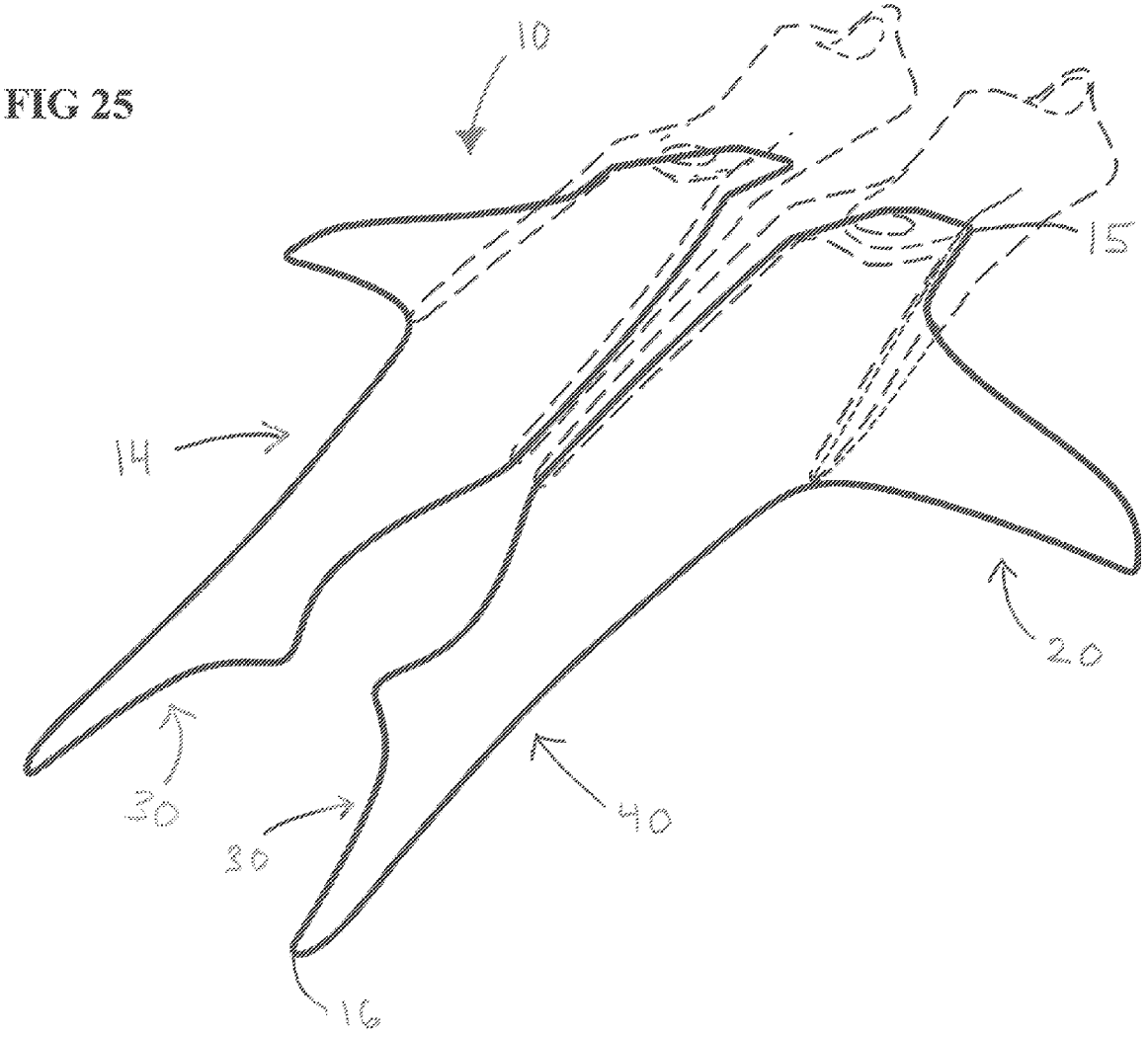
FIG. 25 is a perspective view illustrative of yet one further embodiment of a pair of composite dive fin assemblies in accordance with the present invention.
Figure 26:
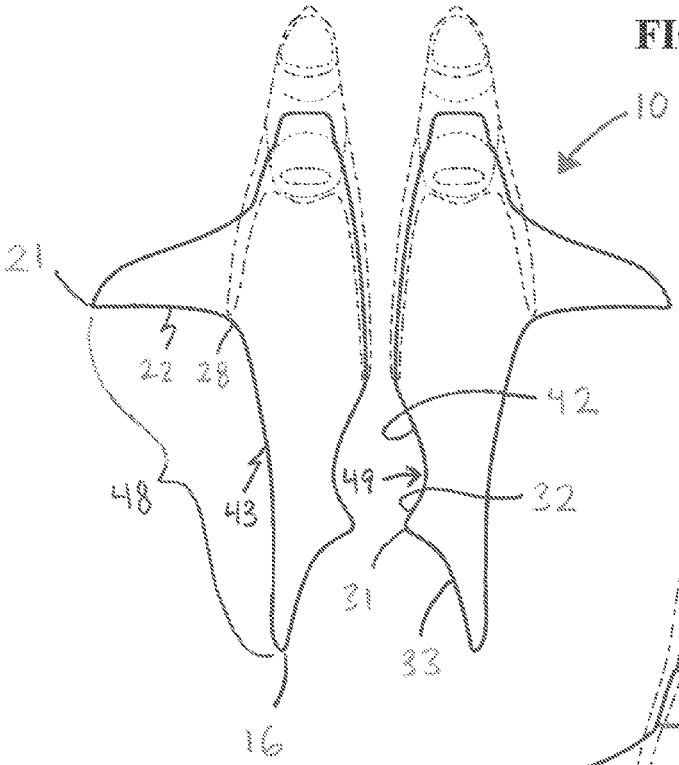
FIG. 26 is a top plan view of the pair of composite dive fin assemblies of the illustrative embodiment of FIG. 25.
Figure 27:
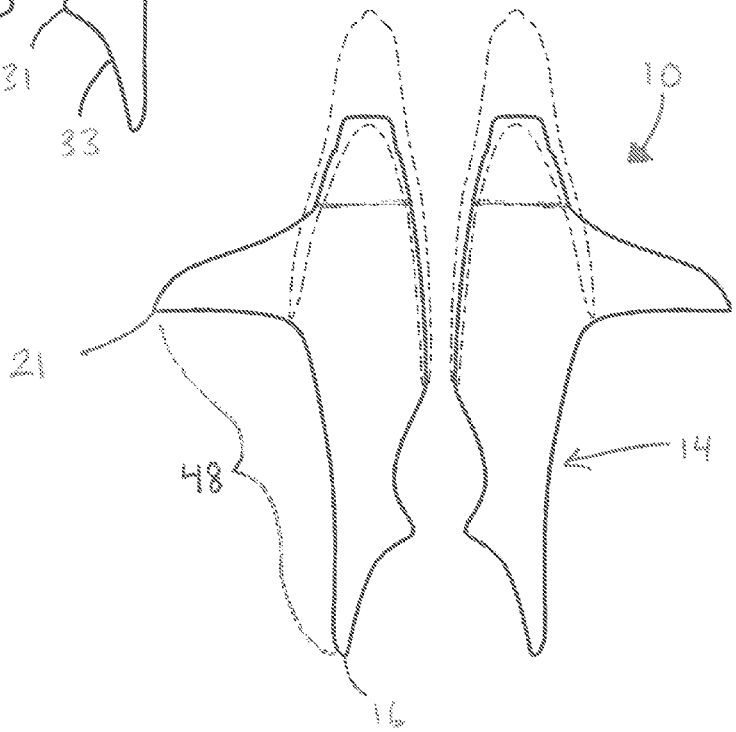
FIG. 27 is a bottom plan view of the pair of composite dive fin assemblies of the illustrative embodiment of FIG. 25.
Figure 28:
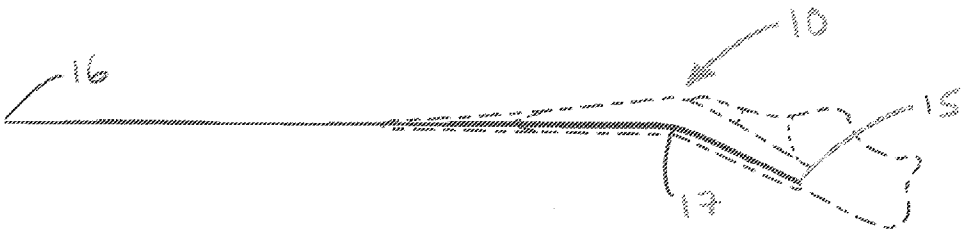
FIG. 28 is a side elevation of one of the composite dive fin assemblies of the illustrative embodiment of FIG. 25.
Figure 29:
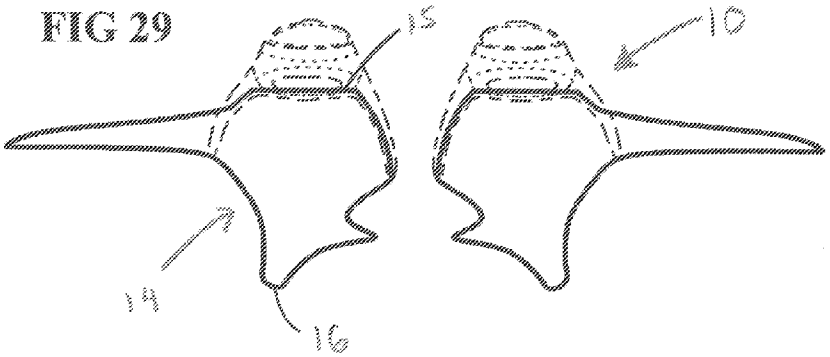
FIG. 29 is a front elevation of the pair of composite dive fin assemblies of the illustrative embodiment of FIG. 25.
Figure 30:
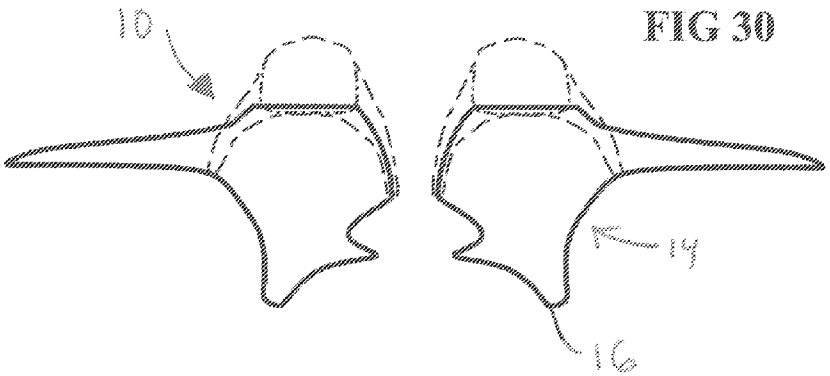
FIG. 30 is a rear elevation of the pair of composite dive fin assemblies of the illustrative embodiment of FIG. 25.

Having thoroughly disclosed the illustrative embodiment of the composite dive fin assembly 10 of the present invention as shown in FIGS. 1 through 6, we turn now to the alternate embodiments illustrated in FIG. 7 through 36. Looking first to the illustrative embodiment of the composite dive fin assembly 10 of FIGS. 7 through 12, we note that this is substantially similar to the embodiment of FIGS. 1 through 6, having a proximal end 15, distal end 16, with primary portion 20, secondary portion 30, and lateral portion 40 disposed therebetween. The primary portions 20 of this embodiment, however, comprise a more rounded configuration which, as noted above, is structured to generally resemble the tail fin of an ocean white shark. Specifically, looking to FIGS. 8 and 9, primary leading edge 22 and primary propulsion edge 23 do not converge to form a distinct primary portion tip 21, such as is illustrated in the embodiment of FIGS. 2 and 3. Rather, as shown in FIGS. 8 and 9, the primary portion tips 21 form continuous rounded edge between corresponding primary leading edges 22 and primary propulsion edges 23. Furthermore, the primary portion tips 21, tend to droop downwardly as the primary prior 20 extends outwardly from the composite fin 14, as shown best in FIGS. 11 and 12.

Looking next to the illustrative embodiment of the composite dive fin assembly 10 of FIGS. 13 through 18, we note that this is also substantially similar to the embodiment of FIGS. 1 through 6, having a proximal end 15, distal end 16, with primary portion 20, secondary portion 30, and lateral portion 40 disposed therebetween. The secondary portion 30 of this embodiment, however, comprises a generally lateral configuration, which functions similar to lateral portion 40. Specifically, looking to FIGS. 14 and 15, the break point 49 occurs at a notch or indent into lateral propulsion edge 43, rather than at a protruding secondary leading edge 32, as in the previously disclosed embodiments of the present invention. As before, however, the break point 49 is a transition between thinner and thicker portions of the composite fin 14, and thus, the secondary portion 30 will tend to flex or snap relative to the thinner lateral portion 40 during a change in direction of a stroke. Once again, the flex or snap of the secondary portion 30 will rapidly displace an additional amount of water over secondary propulsion edge 33, resulting in an added boost or thrust to the swimmer as he or she moves through the water.

The illustrative embodiment of the pair of composite fin assemblies 10 in FIGS. 19 through 24 are structured to represent the configuration of the tail fin of a thresher shark, which is readily identifiable by its long slender tail fin, as seen in the figures. The illustrative embodiment presented in FIGS. 19 through 24 is very similar to the embodiment of FIGS. 13 through 18, in that the break point 49 occurs at a notch or indent into lateral propulsion edge 43, rather than at a protruding secondary leading edge 32, as in previously disclosed embodiments. The breakpoint 49 in the present embodiment comprises a smoother, more arcuate transition from the lateral propulsion edge 43 to the secondary leading edge 32, as shown best in FIGS. 20 and 21. However, the break point 49 serves the same function as in prior embodiments, that is, providing a transition between thinner and thicker portions of the composite fin 14 such that the secondary portion 30 will tend to flex or snap relative to the thinner lateral portion 40 during a change in direction of a stroke so as to rapidly displace an additional amount of water over secondary propulsion edge 33, resulting in an added boost or thrust to the swimmer as he or she moves through the water.

Looking next to the further illustrative alternate embodiment presented in FIGS. 25 through 30, the composite dive assemblies 10 are configured to resemble the tail fin of a tiger shark. Once again, this embodiment is similar to the embodiment of FIGS. 1 through 6, having a proximal end 15, distal end 16, with primary portion 20, secondary portion 30, and lateral portion 40 disposed therebetween. However, as is readily apparent from these figures, in this embodiment the secondary portion 30 extends outwardly from the composite fin 14 in a direction opposite that of primary portions 20. As a result, the primary propulsion edge 23, transition propulsion edge 28, and lateral propulsion edge 43 form a single continuous propulsion edge 48 which extends from primary portion tip 21 to the distal end 16 of the composite fin 14, as illustrated best in FIGS. 26 and 27.

Figure 31:
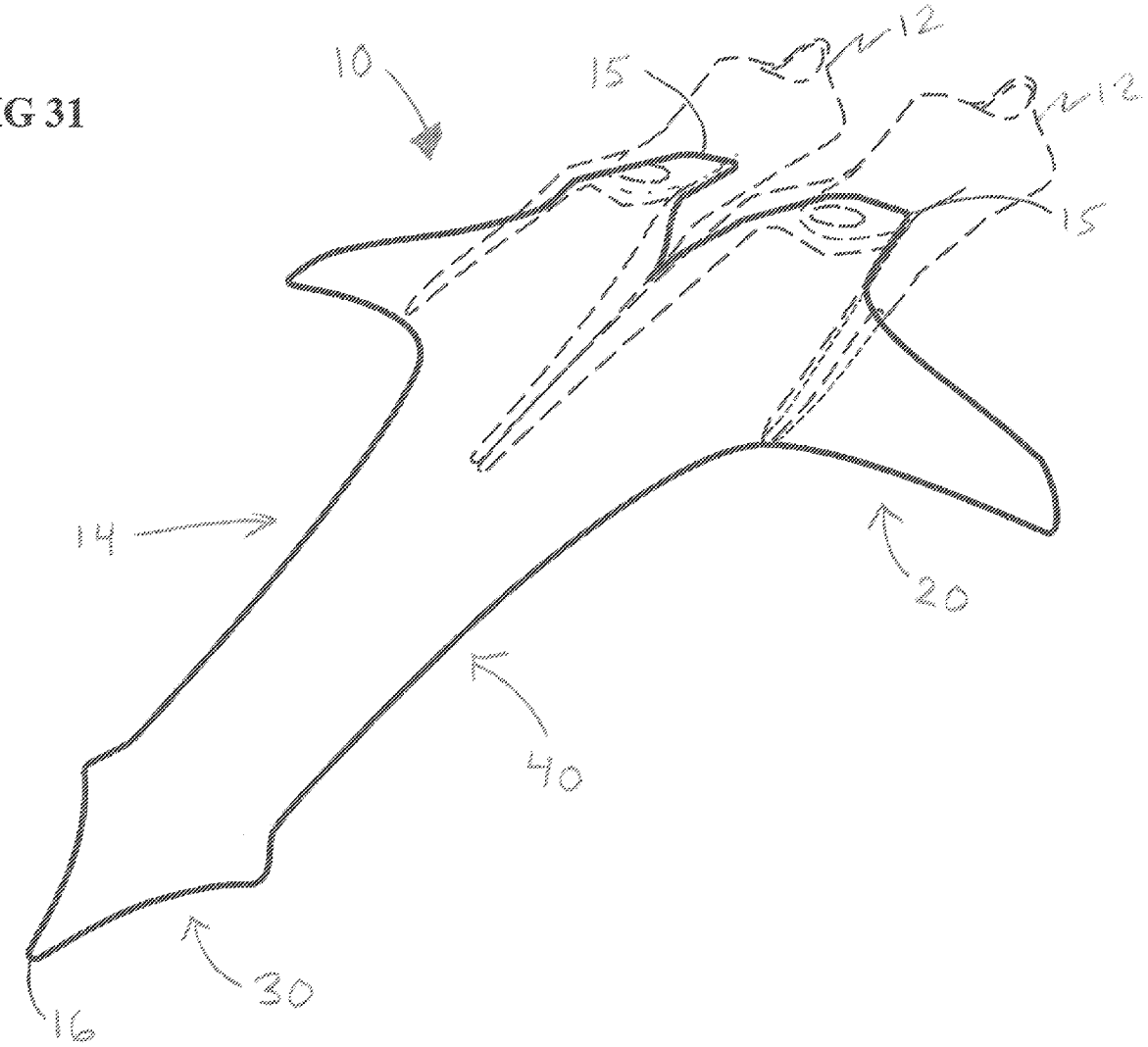
FIG. 31 is a perspective view illustrative one alternate embodiment of a composite dive fin assembly in accordance with the present invention.
Figure 32:
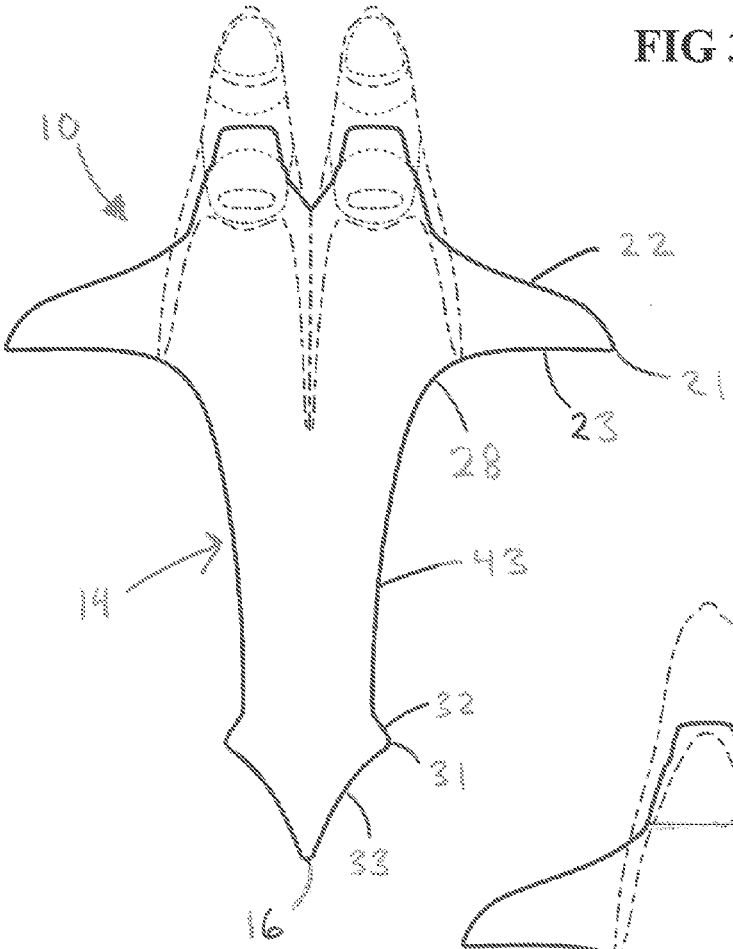
FIG. 32 is a top plan view of the composite dive fin assembly of the illustrative alternate embodiment of FIG. 31.
Figure 33:
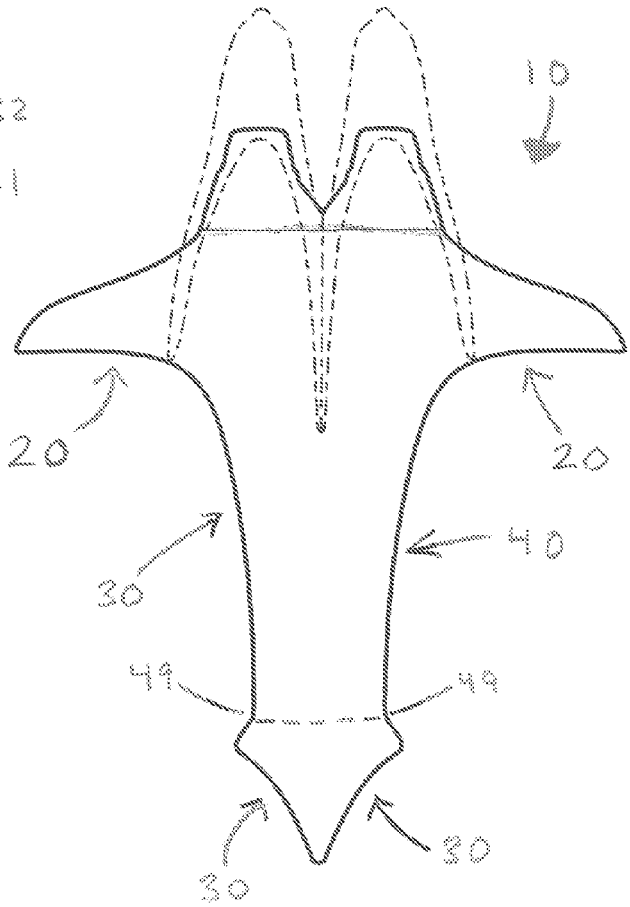
FIG. 33 is a bottom plan view of the composite dive fin assembly of the illustrative alternate embodiment of FIG. 31.
Figure 34:
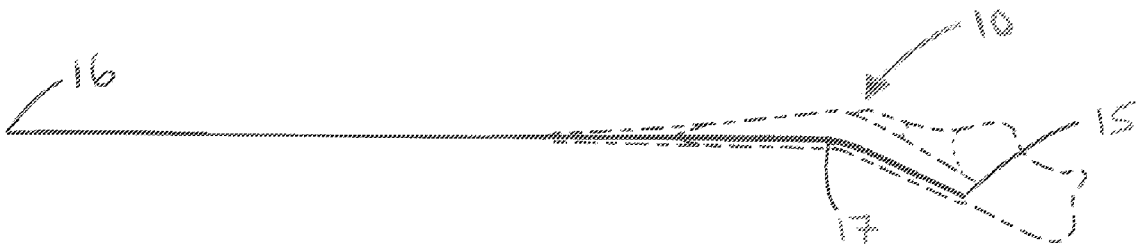
FIG. 34 is a side elevation of the composite dive fin assembly of the illustrative alternate embodiment of FIG. 31.
Figure 35:
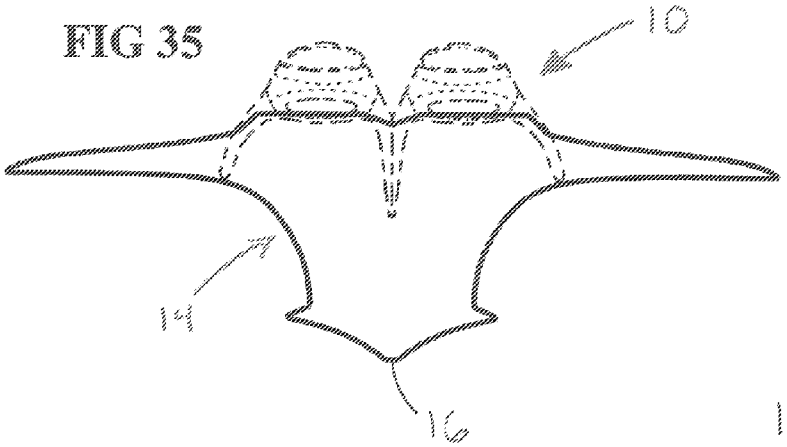
FIG. 35 is a front elevation of the composite dive fin assembly of the illustrative alternate embodiment of FIG. 31.
Figure 36:
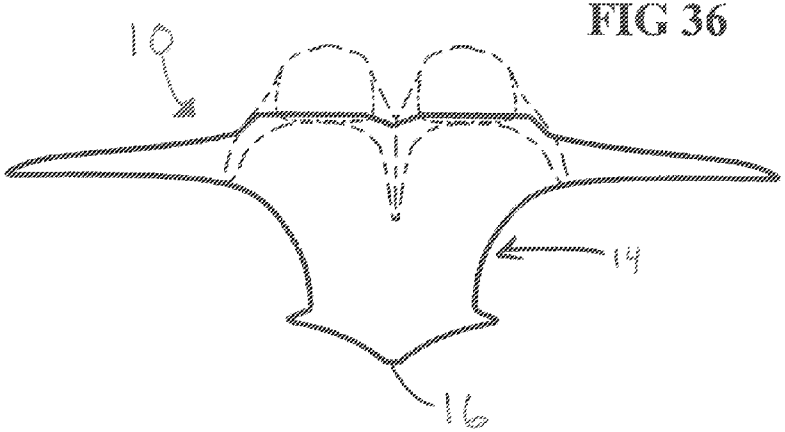
FIG. 36 is a rear elevation of the composite dive fin assembly of the illustrative alternate embodiment of FIG. 31.

FIGS. 31 through 36 are illustrative of one further alternate embodiment of a composite dive fin assembly 10 in accordance with the present invention. In particular, and as shown in FIG. 31, a composite dive fin assembly 10 in accordance with this embodiment comprises a single composite dive fin 14. As noted above, the embodiment of FIGS. 31 through 35 are representative of the pair of composite dive fin assemblies 10 of FIGS. 1 through 6 being joined together along opposing inner edges 42 of corresponding lateral portions 40 creating a monofin. Of course, in the present embodiment, the lateral portion 40 comprises no inner edge 42. Rather, and as shown best in FIGS. 32 and 33, the composite dive fin assembly 10 of the present embodiment, and more in particular the composite dive fin 14, comprises a corresponding and oppositely disposed primary portions 20, secondary portions 30, and lateral portions 40. Break point 49, in accordance with the present embodiment, function similar to flex line 17, extending along an imaginary line extending between oppositely disposed break points 49, as shown best in FIG. 33. As further illustrated in FIG. 31, the present embodiment comprises a pair of foot holds 12 mounted thereto, to allow a user to removably position the composite dive fin assembly 10 onto both of his or her feet.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A composite dive fin assembly for a user swimming in a body of water, said composite dive fin assembly comprising:

a foot hold removably positionable onto one of the user's feet, a composite fin having a proximal end and a distal end, said foot hold mounted adjacent said proximal end, a primary portion having a primary leading edge and a primary propulsion edge defining oppositely disposed primary propulsion surfaces therebetween, a secondary portion having a secondary leading edge and a secondary propulsion edge defining oppositely disposed secondary propulsion surfaces therebetween, a lateral portion disposed between said primary portion and said secondary portion, said lateral portion comprising a lateral propulsion edge and oppositely disposed lateral propulsion surfaces, a flex line proximate said foot hold, said proximal end and said distal end forming a flex angle along said flex line in a range of about twenty degrees to thirty degrees, wherein said flex angle between said proximal end and said distal end of said composite fin reduces resistive forces while displacing an amount of water over said primary propulsion edge, said secondary propulsion edge, and said lateral propulsion edge, and wherein a distance from said primary propulsion edge to said proximal end is less than a distance from said secondary propulsion edge to said proximal end, and said primary propulsion edge extends farther than said lateral propulsion edge in a direction substantially transverse to a line between said proximal end and said distal end.

2. The composite dive fin assembly as recited in claim 1 wherein said lateral propulsion edge is disposed in a transverse orientation relative to said primary propulsion edge.

3. The composite dive fin assembly as recited in claim 2 further comprising a transition zone having a transition zone edge.

4. The composite dive fin assembly as recited in claim 3 wherein said transition zone edge comprises an arcuate configuration.

5. The composite dive fin assembly as recited in claim 4 wherein said primary propulsion edge, said transition zone edge, and said lateral propulsion edge define a continuous propulsion edge.

6. The composite dive fin as recited in claim 5 wherein said transition zone comprises oppositely disposed transition zone propulsion surfaces and wherein correspondingly disposed ones of said primary propulsion surfaces, said transition zone propulsion surfaces, and said lateral propulsion surfaces are cooperatively and collectively structured to displace water over said continuous propulsion edge when said composite dive fin assembly is moved in the body of water transverse to a direction in which the user is swimming.

7. The composite dive fin assembly as recited in claim 1 wherein correspondingly disposed ones of said primary propulsion surfaces, said secondary propulsion surfaces, and said lateral propulsion surfaces cooperatively oriented to displace an amount of water over a corresponding one of said primary propulsion edge, said secondary propulsion edge, and said lateral propulsion edge when said composite dive fin assembly is moved in the body of water transverse to a direction in which the user is swimming.

8. A composite dive fin assembly for a user swimming in a body of water, said composite dive fin assembly comprising:

a foot hold removably positionable onto one of the user's feet, a composite fin having a proximal end and a distal end, said foot hold mounted adjacent said proximal end, a primary portion having a primary leading edge and a primary propulsion edge defining oppositely disposed primary propulsion surfaces therebetween, a secondary portion having a secondary leading edge and a secondary propulsion edge defining oppositely disposed secondary propulsion surfaces therebetween, a lateral portion disposed between said primary portion and said secondary portion, said lateral portion comprising an inner edge and a lateral propulsion edge defining oppositely disposed lateral propulsion surfaces therebetween, a flex line proximate said foot hold, said proximal end and said distal end forming a flex angle along said flex line in a range of about twenty degrees to thirty degrees, wherein said flex angle between said proximal end and said distal end of said composite fin reduces resistive forces while displacing an amount of water over said primary propulsion edge, said secondary propulsion edge, and said lateral propulsion edge, wherein a distance from said primary propulsion edge to said proximal end is less than a distance from said secondary propulsion edge to said proximal end, and said primary propulsion edge extends farther than said lateral propulsion edge in a direction substantially transverse to a line between said proximal end and said distal end, and correspondingly disposed ones of said primary propulsion surfaces, said secondary propulsion surfaces, and said lateral propulsion surfaces cooperatively oriented to displace an amount of water over a corresponding one of said primary propulsion edge, said secondary propulsion edge, and said lateral propulsion edge when said composite dive fin assembly is moved in the body of water transverse to a direction in which the user is swimming.

9. The composite dive fin assembly as recited in claim 8 wherein said correspondingly disposed ones of primary propulsion surfaces, said secondary propulsion surfaces, and said lateral propulsion surfaces are cooperatively configured to reduce resistive forces while displacing an amount of water over a corresponding one of said primary propulsion edge, said secondary propulsion edge, and said lateral propulsion edge.

10. The composite dive fin assembly as recited in claim 8 wherein said primary propulsion surface displaces water over said primary propulsion edge in a direction opposite the direction in which the user is swimming.

11. The composite dive fin assembly as recited in claim 8 wherein said secondary propulsion surface displaces water over said secondary propulsion edge in a direction opposite the direction in which the user is swimming.

12. The composite dive fin assembly as recited in claim 8 wherein said lateral propulsion surface displaces water over said lateral propulsion edge in a direction transverse to the direction in which the user is swimming.

13. The composite dive fin assembly as recited in claim 8 wherein said secondary propulsion surface displaces water over said secondary propulsion edge in a direction transverse to the direction in which the user is swimming.

14. A composite dive fin assembly for a user swimming in a body of water, said composite dive fin assembly comprising:

a foot hold removably positionable onto one of the user's feet, a composite fin having a proximal end and a distal end, said foot hold mounted adjacent said proximal end, a primary portion having a primary leading edge and a primary propulsion edge defining oppositely disposed primary propulsion surfaces therebetween, a secondary portion having a secondary leading edge and a secondary propulsion edge defining oppositely disposed secondary propulsion surfaces therebetween, a lateral portion disposed between said primary portion and said secondary portion, said lateral portion comprising an inner edge and a lateral propulsion edge defining oppositely disposed lateral propulsion surfaces therebetween, a transition zone between said primary portion and said lateral portion, wherein said transition zone comprises an arcuate transition zone edge, a flex line proximate said foot hold, said proximal end and said distal end forming a flex angle along said flex line in a range of about twenty degrees to thirty degrees, wherein said flex angle between said proximal end and said distal end of said composite fin reduces resistive forces while displacing an amount of water over said primary propulsion edge, said secondary propulsion edge, and said lateral propulsion edge, wherein a distance from said primary propulsion edge to said proximal end is less than a distance from said secondary propulsion edge to said proximal end, and said primary propulsion edge extends farther than said lateral propulsion edge in a direction substantially transverse to a line between said proximal end and said distal end, and correspondingly disposed ones of said primary propulsion surfaces, said secondary propulsion surfaces, and said lateral propulsion surfaces cooperatively oriented to displace an amount of water over a corresponding one of said primary propulsion edge, said secondary propulsion edge, said arcuate transition zone edge, and said lateral propulsion edge when said composite dive fin assembly is moved in the body of water transverse to a direction in which the user is swimming.

15. The composite dive fin assembly as recited in claim 14 wherein said secondary portion flexes relative to said lateral portion to provide a secondary thrust during transitions between an upward stroke and a downward stroke.

16. The composite dive fin assembly as recited in claim 14 wherein said secondary portion flexes relative to said lateral portion to provide a secondary thrust during transitions between a downward stroke and an upward stroke.

17. The composite dive fin assembly as recited in claim 15 wherein said secondary portion flexes relative to said lateral portion to provide a secondary thrust during transitions between a downward stroke and an upward stroke.

18. The composite dive fin assembly as recited in claim 14 wherein correspondingly disposed ones of said primary propulsion surfaces, said secondary propulsion surfaces, and said lateral propulsion surfaces are cooperatively configured to reduce resistive forces while displacing the amount of water over a corresponding one of said primary propulsion edge, said secondary propulsion edge, and said lateral propulsion edge.

* * * * *